US007524162B2

(12) United States Patent
Reigl

(10) Patent No.: US 7,524,162 B2
(45) Date of Patent: Apr. 28, 2009

(54) ROTOR FOR A ROTATING MACHINE, IN PARTICULAR A STEAM TURBINE

(75) Inventor: Martin Reigl, Ehrendingen (CH)

(73) Assignee: Alstom Technology Ltd, Baden (CH)

( * ) Notice: Subject to any disclaimer, the term of this patent is extended or adjusted under 35 U.S.C. 154(b) by 434 days.

(21) Appl. No.: 11/391,902

(22) Filed: Mar. 29, 2006

(65) Prior Publication Data

US 2006/0222504 A1 Oct. 5, 2006

(30) Foreign Application Priority Data

Mar. 30, 2005 (CH) ..... 00549/05

(51) Int. Cl.
*F03B 3/12* (2006.01)

(52) U.S. Cl. ..... 415/104; 415/173.6; 415/173.7; 415/174.4; 415/200; 416/144; 416/223 R; 416/229 R; 416/241 R

(58) Field of Classification Search ..... 415/104, 415/173.6, 173.7, 174.4, 200; 416/144, 223 R, 416/229 R, 241 R
See application file for complete search history.

(56) References Cited

U.S. PATENT DOCUMENTS

| | | | | |
|---|---|---|---|---|
| 2,456,779 | A * | 12/1948 | Goetzel | 416/248 |
| 2,946,681 | A * | 7/1960 | Probst et al. | 419/2 |
| 2,952,442 | A * | 9/1960 | Warnken | 416/190 |
| 3,046,648 | A * | 7/1962 | Kelly | 415/174.4 |
| 4,502,838 | A * | 3/1985 | Miller et al. | 415/202 |
| 4,661,043 | A | 4/1987 | Groenendaal, Jr. et al. | 415/104 |
| 4,755,103 | A | 7/1988 | Streifinger | 415/111 |
| 4,934,580 | A | 6/1990 | Sutton | 228/157 |
| 6,263,953 | B1 | 7/2001 | Emil | 164/475 |
| 6,827,556 | B2 * | 12/2004 | Simon | 416/241 R |
| 6,840,301 | B2 | 1/2005 | Nichol et al. | 164/79 |
| 6,971,841 | B2 * | 12/2005 | Care | 415/9 |
| 2005/0069411 | A1 | 3/2005 | Bast et al. | 415/199.5 |

FOREIGN PATENT DOCUMENTS

| | | |
|---|---|---|
| EP | 0 234 439 | 9/1987 |
| EP | 1 186 748 | 3/2002 |
| EP | 1 329 592 | 7/2003 |
| GB | 662527 | 12/1951 |
| WO | WO 2004/101209 | 11/2004 |

* cited by examiner

*Primary Examiner*—Igor Kershteyn
(74) *Attorney, Agent, or Firm*—Darby & Darby

(57) ABSTRACT

A rotor for a rotating machine, in particular a steam turbine includes at least one subregion composed of a metal structure having a reduced density and including a multiplicity of finely distributed cavities.

15 Claims, 5 Drawing Sheets

ROTOR FOR A ROTATING MACHINE, IN PARTICULAR A STEAM TURBINE

Priority is claimed to Swiss Patent Application No. CH 00549/05, filed on Mar. 30, 2005, the entire disclosure of which is incorporated by reference herein.

The present invention deals with the field of rotating machines. It relates to a rotor for a rotating machine, in particular a steam turbine.

BACKGROUND

Rotors of steam turbines are exposed to high stresses caused by centrifugal forces and temperature differences. The former mainly restrict the diameter of the rotor which can be installed, while the latter mainly reduce the service life as a result of LCF (Low Cycle Fatigue) stresses.

Hitherto, rotors have been produced primarily from steel alloys, in some cases using large cavities, as are formed in the case of rings of rotors welded together (cf. for example WO-A1-2004/101209).

On the other hand, it is known to foam metals and in this way to produce porous metal structures. Extensive tests have been carried out using aluminum foams (cf. for example U.S. Pat. No. B1-6,840,301). It is also known that foaming is in principle possible for all metals, i.e. including steels (cf. for example U.S. Pat. No. 6,263,953). The metal foams in this case have a continuous surface. The foam structure is therefore not visible from the outside.

SUMMARY OF THE INVENTION

It is an object of the invention to provide a rotor which, by exploiting the advantages of metal structures of reduced density, such as for example metal foams, with regard to centrifugal forces and temperature differences, can be exposed to higher levels of load.

The present invention provides a rotor that, at least in subregions, is composed of a metal structure which has a reduced density and includes a multiplicity of finely distributed cavities.

A first configuration of the rotor according to the invention is characterized in that the metal structure of reduced density comprises a metal foam, that the metal foam is a steel foam or a foam of a nickel-base alloy, and that the metal structure has a continuous surface.

A second, alternative configuration is distinguished by the fact that the metal structure of reduced density comprises a plurality of metal sheets, which cross one another so as to form cavities and are connected to one another, in particular by welding, screw connection or riveting.

The subregions having the metal structure of reduced density can be formed integrally on the rotor during production of the rotor.

However, it is also conceivable for the subregions having the metal structure of reduced density to be formed as separate elements and be connected to the remainder of the rotor, in which case the separate elements are connected to the remainder of the rotor at least in a positively locking manner and/or are welded to the remainder of the rotor or are joined to the remainder of the rotor by means of a shrink-fit connection.

The subregions having the metal structure of reduced density are preferably provided at locations of the rotor where the reduced heat conduction and/or weight reduction associated with the subregions is/are advantageous. If, in particular, the rotor has a balance piston, a subregion having a metal structure of reduced density is provided all the way around the outside of the balance piston.

BRIEF DESCRIPTION OF THE DRAWINGS

The invention is to be explained in more detail below on the basis of exemplary embodiments in conjunction with the drawing, in which.

DETAILED DESCRIPTION

Figure 1:
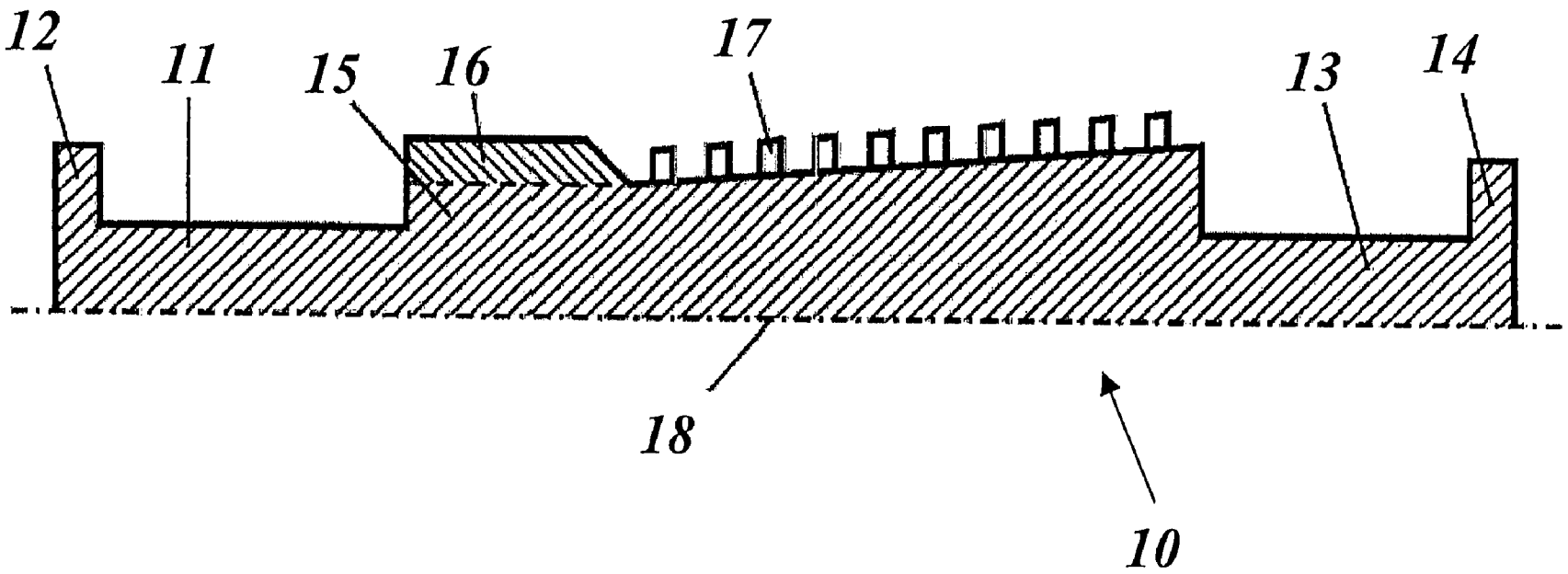
FIG. 1 shows a simplified longitudinal section through a first exemplary embodiment of a rotor according to the invention for a steam turbine with a balance piston which has an integrally formed outer subregion of metal foam.

FIG. 1 shows a simplified longitudinal section through a first exemplary embodiment of a rotor according to the invention for a steam turbine. The rotor 10 is substantially rotationally symmetrical with respect to a rotor axis 18. It is illustrated as being solid, but may also have cavities in the interior. At its two rotor ends 11, 13, the rotor 10 has rotor couplings 12, 14, by means of which it can be connected to a shaft or the like. In a middle section, the rotor 10 is provided with blading 17, at which the steam flowing through the steam turbine performs work. To compensate for the axial shear forces which then occur, a balance piston 15 is provided on the rotor 10 in a manner known per se (cf. for example U.S. Pat. No. 4,661,043).

The rotor according to the invention partially or completely comprises a metal foam, preferably steel foam or, in the case of extremely high temperatures, a foam of a nickel-base alloy. A rotor construction which partially comprises metal foam and partially comprises unfoamed metal is preferred. The unfoamed, i.e. conventional, metal is in this case used primarily at the locations which are subjected to high stresses on account of the blade centrifugal forces. The foamed metal is employed in particular where the effect brought about by the associated weight saving or brought about by the associated low heat conduction is advantageous. One such location is in particular the balance piston 15, as indicated in FIG. 1.

Figure 2:
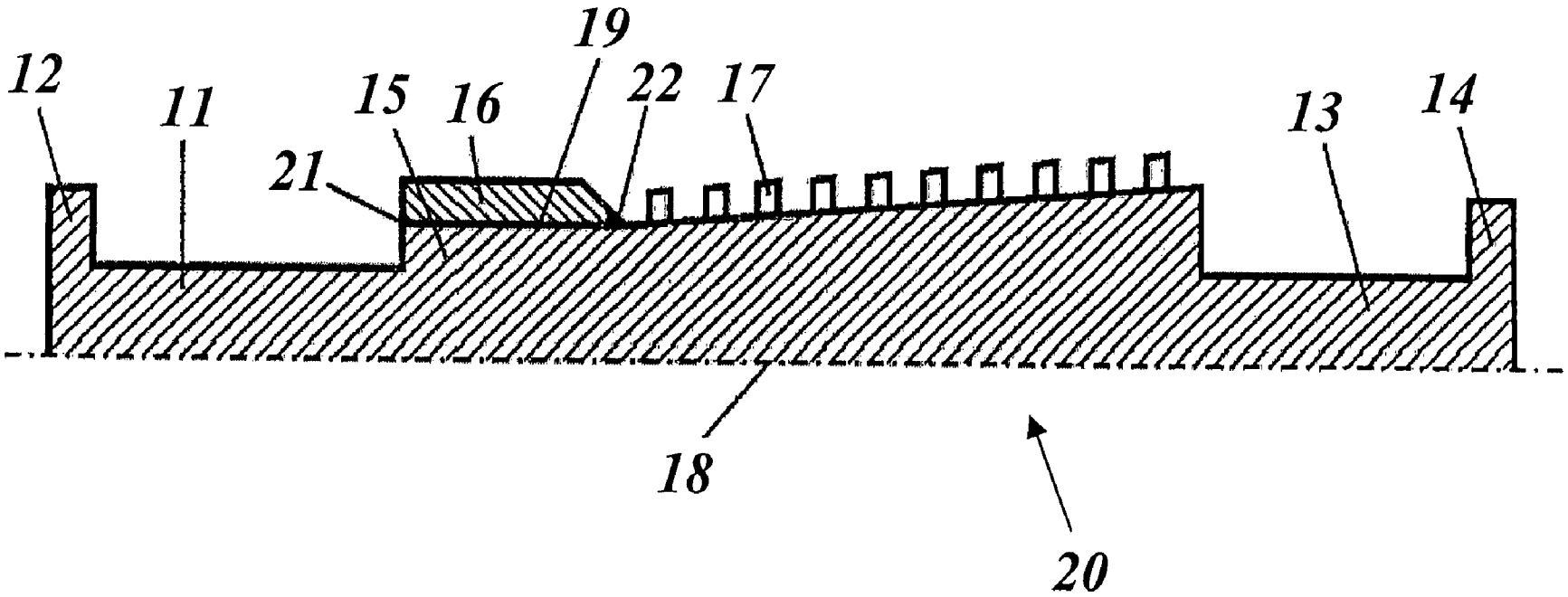
FIG. 2 shows an illustration similar to FIG. 1 of a second exemplary embodiment of a rotor according to the invention for a steam turbine with a balance piston which has an outer subregion of metal foam attached in a positively locking manner.
Figure 3:
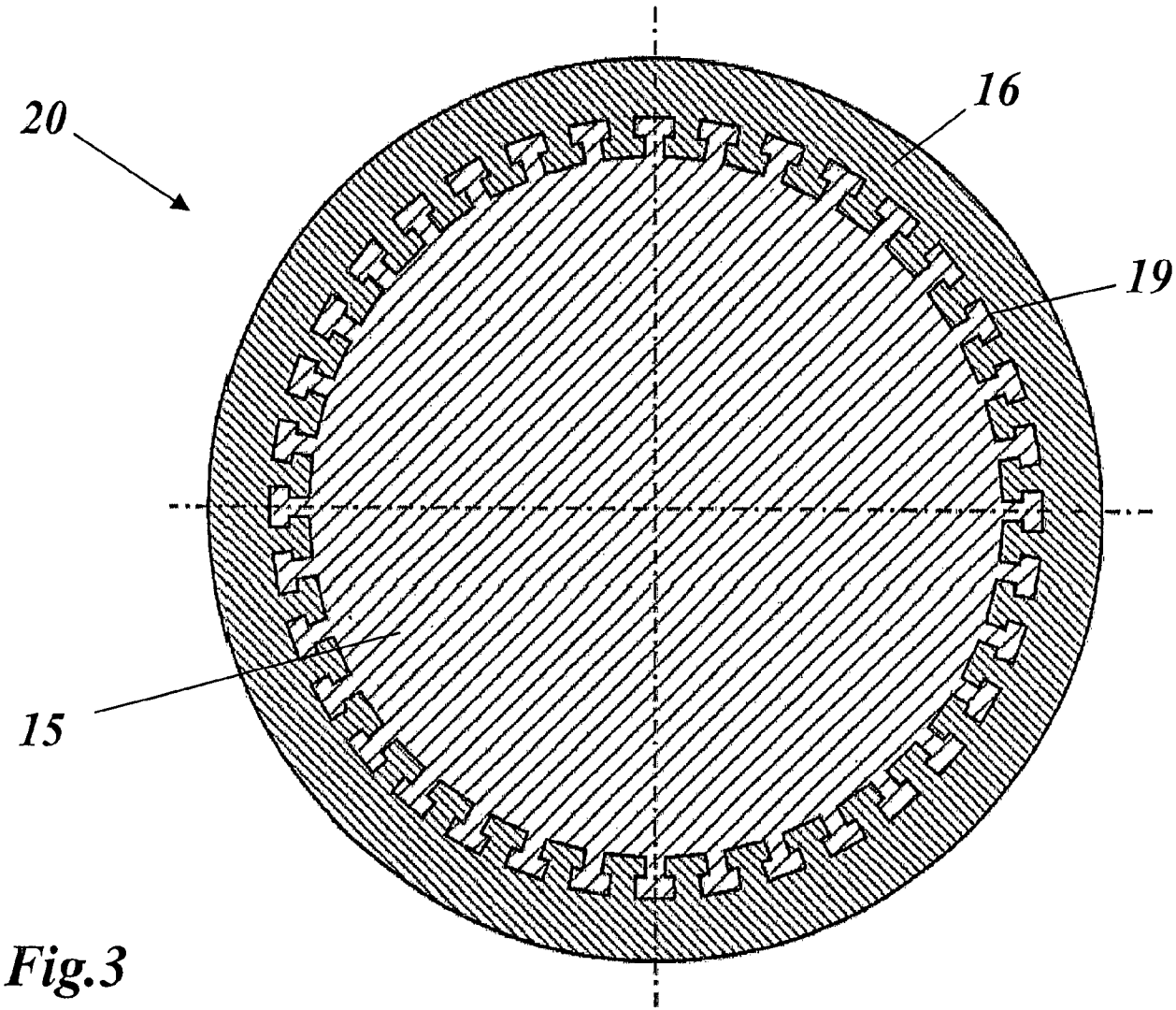
FIG. 3 shows the cross section through the balance piston from FIG. 2.

By way of example, one variant embodiment consists in the rotor being produced from metal foam in a subregion 16 running all the way around the outside of the balance piston, whereas in the center of the rotor it is produced from unfoamed metal (FIG. 1 and FIGS. 2, 3).

If the metal foam is desirable only at selected locations of the rotor, it can either be only locally produced in the rotor on account of the process adopted (FIG. 1), or alternatively it is produced separately and only subsequently connected to the rotor (FIGS. 2 and 3).

Figure 4:
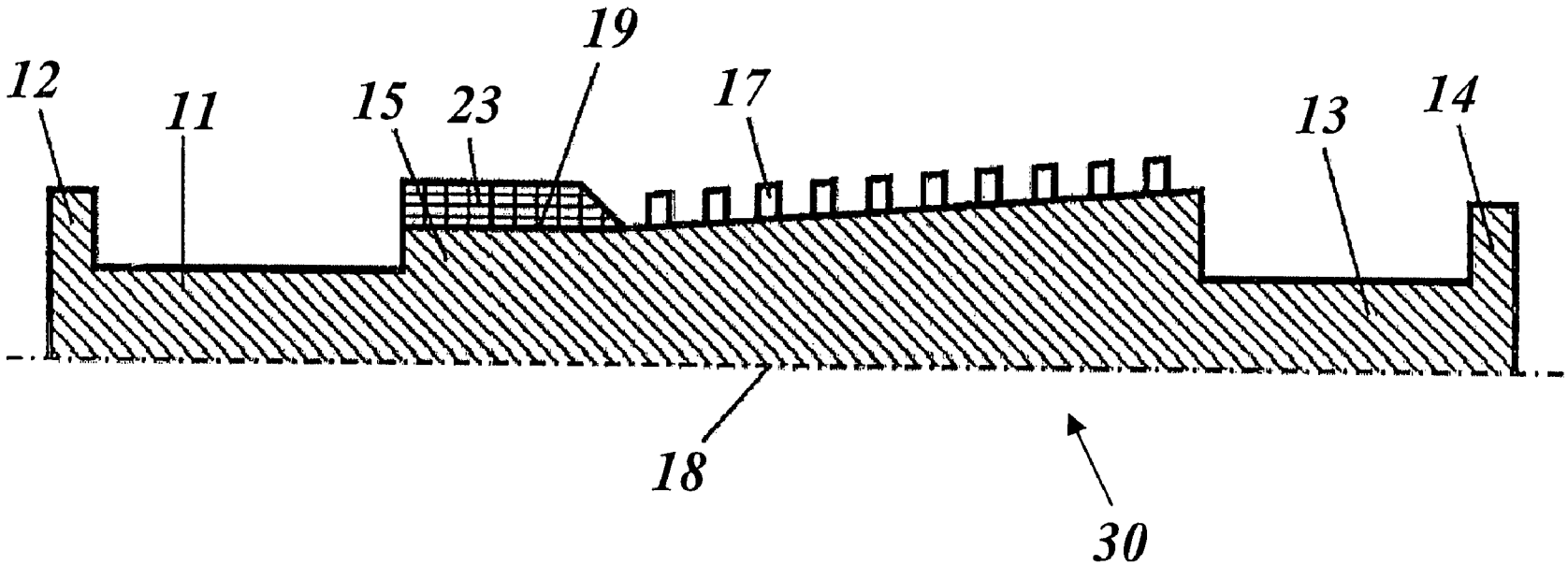
FIG. 4 shows an illustration similar to FIG. 1 of a third exemplary embodiment of a rotor according to the invention for a steam turbine with a balance piston which has an attached outer subregion of a metal structure which is composed of metal sheets and has a reduced density.
Figure 5:
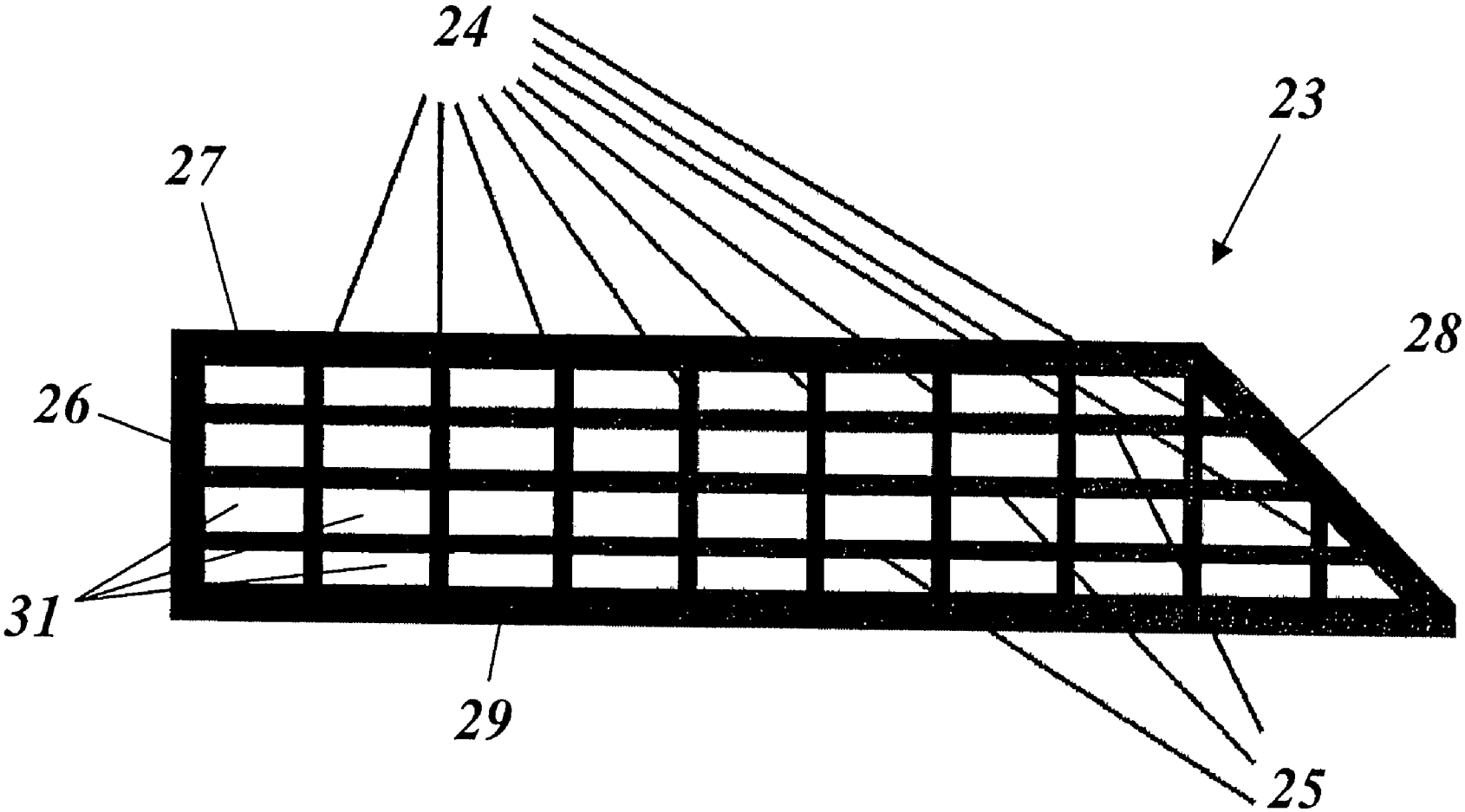
FIG. 5 shows an enlarged longitudinal section through the metal structure of the outer balance piston subregion from FIG. 4.

However, as an alternative to metal foam, it is also possible to use another metal structure containing finely distributed cavities (subregion 23 in FIGS. 4 and 5). By way of example, a cavity structure of this type can be formed by welding metal sheets which cross one another (FIG. 5).

The structure described for the balance piston has the following advantages: on account of the reduced weight of the balance piston, the centrifugal force stress at the center of the rotor is considerably reduced. If the rotor consists of unfoamed metal at the center of the rotor, however, at that location it can withstand the same stress as a conventional rotor. As a result, considerably larger balance pistons become feasible.

Furthermore, on account of the foam bubbles, the heat conduction in the foam is reduced. In the region of the surface consisting of metal foam, in particular at the balance piston, which is positioned in the region of the incoming flow and therefore has the hottest steam flowing around it, much less heat is introduced into the rotor. The thermal stresses are reduced in this way, and the service life of the rotor is thereby increased. Furthermore, on account of the reduced introduction of heat into the rotor, the temperature at the piston-side rotor end (11 in FIG. 1) and in the center of the rotor in the case of the balance piston is lower, with the result that the strength of the rotor even increases there.

FIG. 1 shows an exemplary embodiment of the invention with metal foam in an annular subregion 16 of the balance piston 15 (FIG. 1 illustrates the top half of the sectioned rotor). At the surface of the subregion 16, the metal foam is of closed-cell form, so that the inner (porous) metal structure is not visible from the outside and steam cannot penetrate into the pores of the metal foam.

A further exemplary embodiment is shown in FIG. 2 and FIG. 3. Just as in the previous exemplary embodiment from FIG. 1, the subregion 16 in the outer region of the balance piston 15 is filled with metal foam. However, this region is now a component which is produced separately from the remainder of the rotor 20 and has been connected to the rotor 20 in a pressure-tight manner by means of a weld seam 22. Furthermore, this foamed component 16, at its radially inner boundary surface 19, is connected to the rotor 20 by means of a positively locking connection, in order to enable the centrifugal forces which occur when the rotor 20 rotates to be transmitted from the metal foam 16 to the rotor 20. FIG. 3 shows a positively locking connection of this type in the form of a cross section through the balance piston 15. The separate production of the foamed component 16 from the remainder of the rotor 20 has the advantage that the remainder of the rotor 20 can be better examined for defects in the material using ultrasound.

In a third exemplary embodiment, which is otherwise identical to the second exemplary embodiment, the pressure-tight weld seam 22 is replaced by a weld seam 21 on the opposite side on the balance piston 15.

A fourth exemplary embodiment corresponds to the second and third exemplary embodiments, except that instead of the positively locking connection as shown in FIG. 3 and the weld seam 21, 22 as shown in FIG. 2, the subregion 16 is now seated on the rotor 20 by means of a shrink-fit connection.

FIG. 4 shows a fifth exemplary embodiment. Instead of a porous metal foam, in this case a metal structure equipped with finely distributed cavities 31 is used in the outer subregion 23 of the balance piston 15; in this example, it is shrink-fitted onto the rotor 30 at the boundary surface 19.

FIG. 5 shows an enlarged view of the subregion 23 with its metal structure. The subregion 23 is surrounded on the outer side by thicker outer metal sheets 26, . . . , 29, whereas in the interior thinner inner metal sheets 24 and 25 are arranged in vertical planes and horizontal planes, respectively. In this example, the inner metal sheets 24, 25 are all connected to one another by welding, although the weld seams are not illustrated in FIG. 5.

A sixth exemplary embodiment corresponds to the fifth, except that the inner metal sheets 24, 25 of the cavity structure are connected to one another by screw connection.

A seventh exemplary embodiment likewise corresponds to the fifth, except that the inner metal sheets 24, 25 of the metal structure are connected to one another by riveting.

The number and distribution of the inner metal sheets 24, 25 and the size and distribution of the cavities 31 formed are determining factors for the mechanical stability of the subregion 23 and its thermal conductivity. They have to be selected and defined according to the requirements. The same is true of the size and distribution of the pores if a metal foam is used for the subregion (16 in FIGS. 1, 2).

What is claimed is:

1. A rotor for a rotating machine comprising:

a rotor body having a bladed section; and a plurality of rotor blades, the plurality of rotor blades being mounted on the rotor body within the bladed section, and wherein the rotor body includes at least one subregion disposed outside the bladed section and including a metal structure having a reduced density and including a multiplicity of finely distributed cavities.

2. The rotor as recited in claim 1, wherein the metal structure comprises a metal foam.

3. The rotor as recited in claim 2, wherein the metal foam is a steel foam.

4. The rotor as recited in claim 2, wherein the metal foam is a foam of a nickel-base alloy.

5. The rotor as recited in claim 2, wherein the metal structure has a continuous surface.

6. The rotor as recited in claim 1, wherein the metal structure includes a plurality of metal sheets crossing one another so as to form the cavities and connected to one another.

7. The rotor as recited in claim 6, wherein the metal sheets are connected to one another by one of welding, screw connection and riveting.

8. The rotor as claimed in claim 1, wherein the at least one subregion is formed integrally with a remainder of the rotor.

9. The rotor as recited in claim 1, wherein the at least one subregion is formed as at least one separate element and connected to a remainder of the rotor.

10. The rotor as recited in claim 9, wherein the at least one separate element is connected to the remainder of the rotor at least in a positively locking manner.

11. The rotor as recited in claim 9, wherein the at least one separate element is welded to the remainder of the rotor.

12. The rotor as recited in claim 9, wherein the at least one separate element is joined to the remainder of the rotor via a shrink-fit connection.

13. The rotor as recited in claim 1, wherein the at least one subregion is provided at least one location of the rotor where a reduced heat conduction and/or weight reduction associated with the at least one subregion is advantageous.

14. The rotor as recited in claim 13, further comprising a balance piston, and wherein the at least one subregion is disposed all the way around an outside of the balance piston.

15. The rotor as recited in claim 1, wherein the rotor is part of a steam turbine.

* * * * *